US005447829A

United States Patent [19]

Tamai et al.

[11] Patent Number: 5,447,829

[45] Date of Patent: Sep. 5, 1995

[54] PACKAGE OF ROLLED PHOTOSENSITIVE MATERIAL AND PREPARATION THEREOF

[75] Inventors: Kyoushi Tamai; Kazuo Ui; Kaoru Matsunaga; Yoshio Ishizuka, all of Kanagawa, Japan

[73] Assignee: Fuji Photo Film Co., Ltd., Kanagawa, Japan

[21] Appl. No.: 182,352

[22] Filed: Jan. 18, 1994

[30] Foreign Application Priority Data

Jan. 18, 1993 [JP] Japan ..... 5-005808

[51] Int. Cl.[6] ..... G03C 3/00; B65D 85/676

[52] U.S. Cl. ..... 430/501; 206/316.1; 206/389; 206/397; 242/348.4

[58] Field of Search ..... 430/501; 206/316.1, 206/389, 397; 242/71, 71.1, 71.7, 348.4

[56] References Cited

U.S. PATENT DOCUMENTS 4,505,387 3/1985 Seto ..... 242/71.1
5,133,171 7/1992 Chase et al. ..... 53/409
5,222,601 6/1993 Takahashi et al. ..... 206/416

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A package of a rolled photosensitive material comprising a core, a rolled photosensitive material wound around the core, a light-shielding leader which shields the peripheral face of the rolled photosensitive material from light, a pair of side plate inner rings which shield both sides of the rolled photosensitive material, an adhesive layer which adheres each of the side plate inner rings to the core, a caulking part which is formed on the adhesive layer and which enters the core, and a light-shielding part which is formed on the side plate inner ring, which adheres to the caulking part, and of which the inner end is positioned on the inner part from the surface of the core. The package can ensure light-shielding at the side plate inner ring simply and inexpensively, and having a sufficient adhesive strength between the side plate inner ring and the core.

13 Claims, 5 Drawing Sheets

FIG. 1
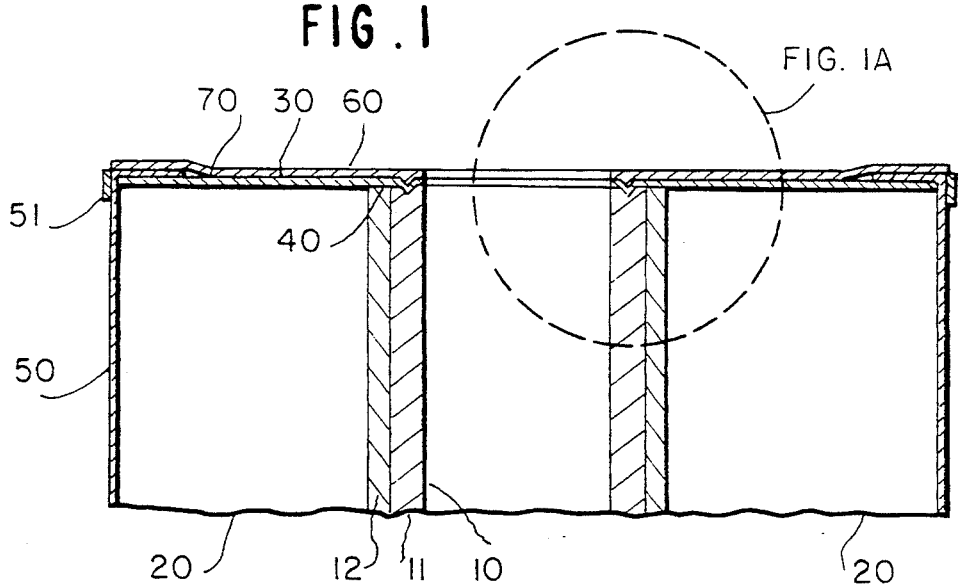
FIG. 1A
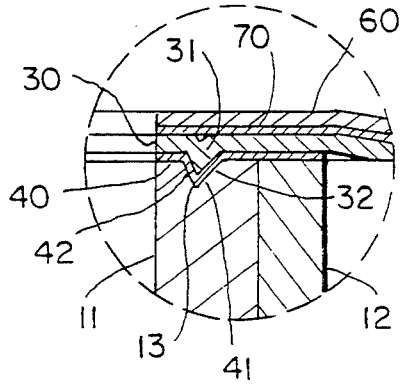
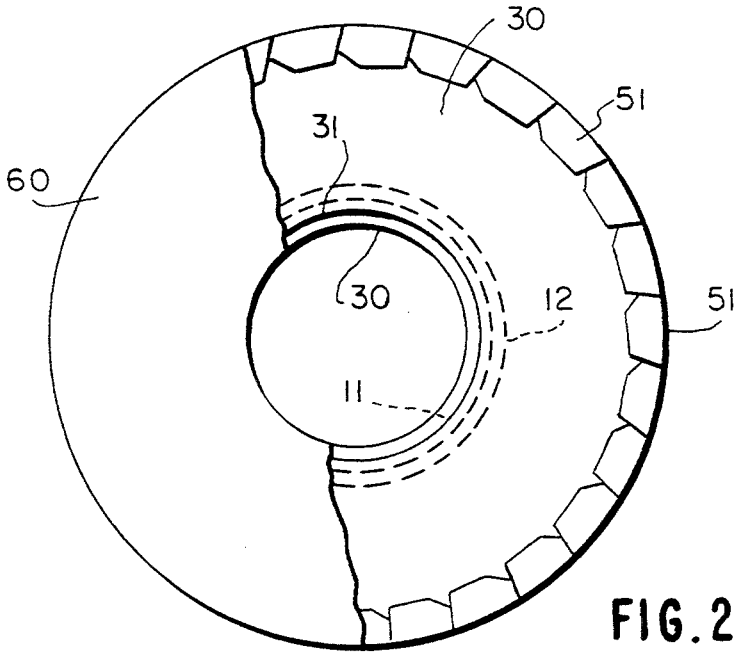
FIG. 2

FIG. 3
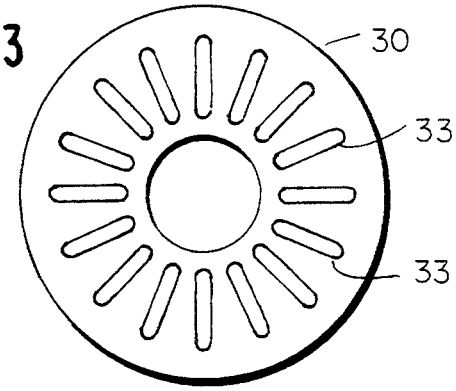
FIG. 4
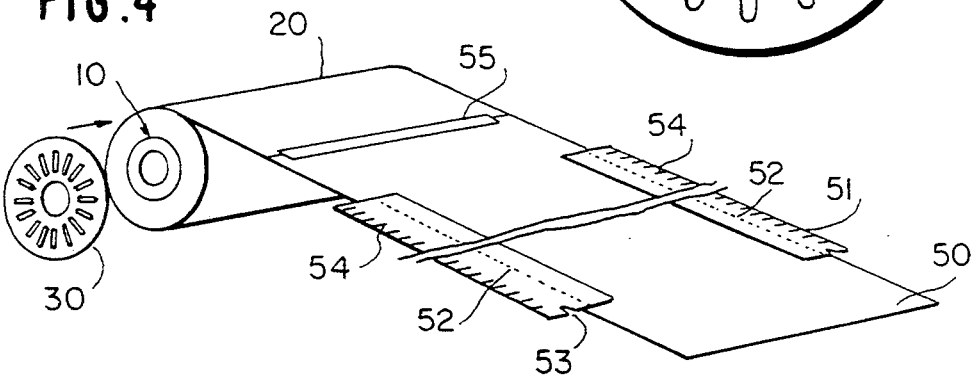
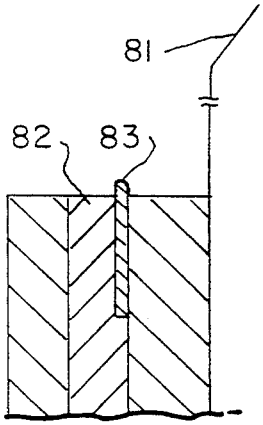
FIG. 6
FIG. 5
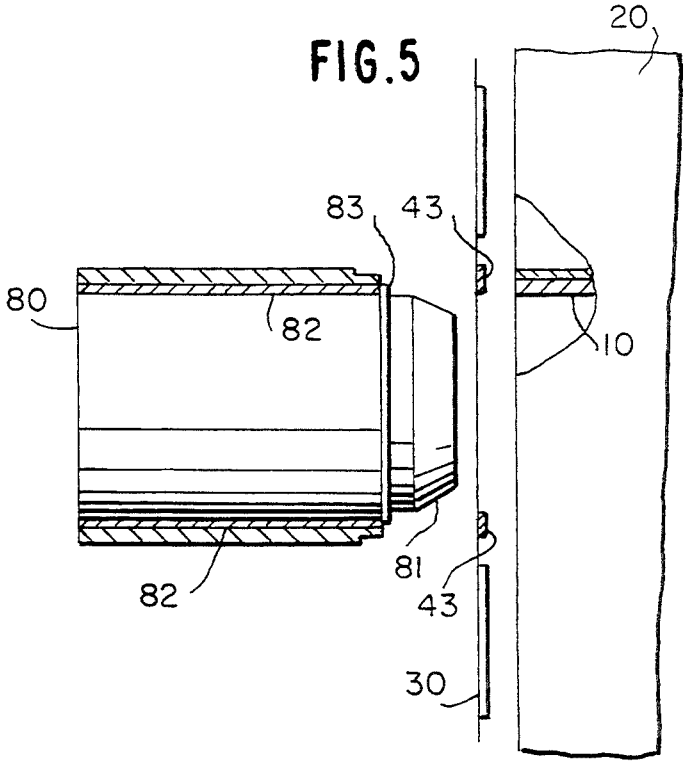

FIG. 7
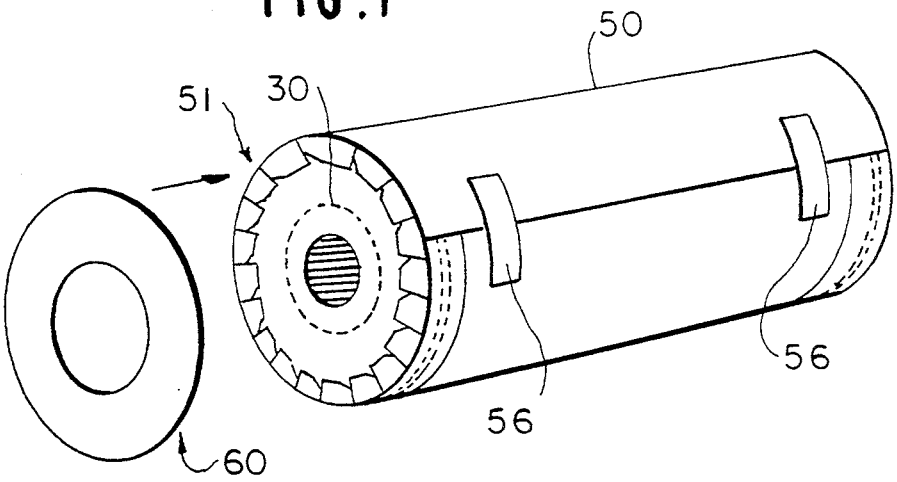
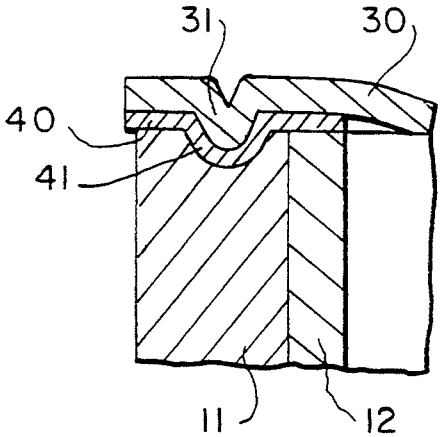
FIG. 8
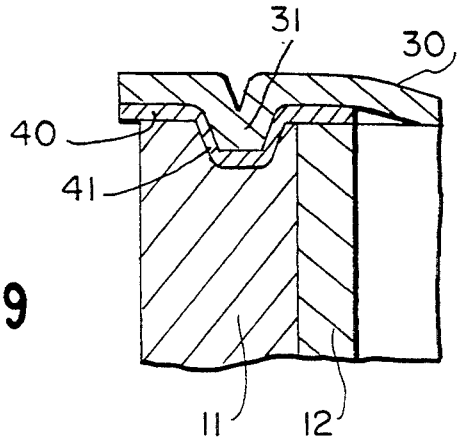
FIG. 9

FIG. 10
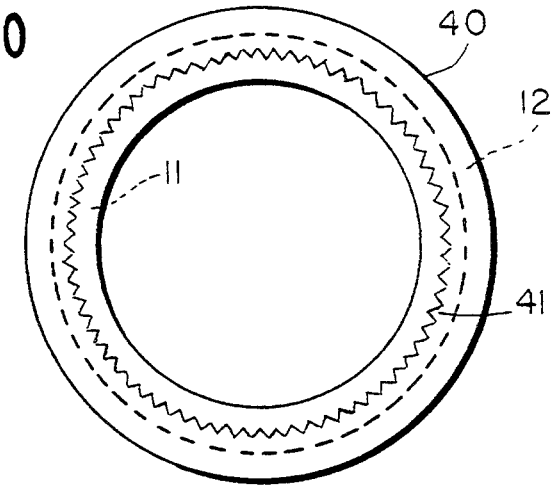
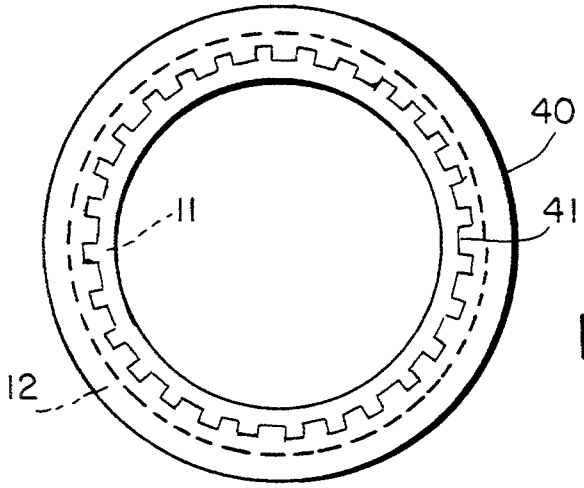
FIG. 11
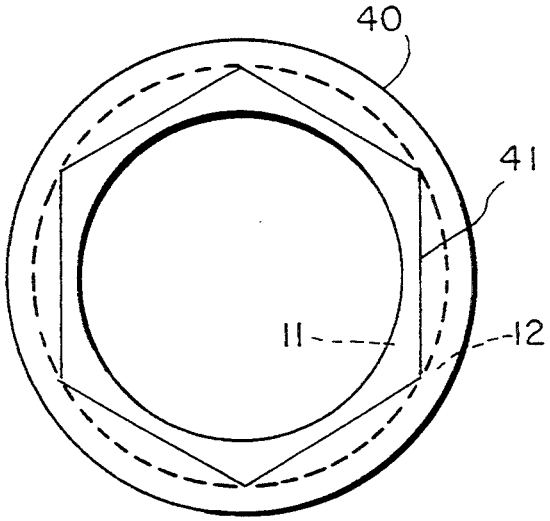
FIG. 12

PACKAGE OF ROLLED PHOTOSENSITIVE MATERIAL AND PREPARATION THEREOF

BACKGROUND OF THE INVENTION

This invention relates to a package of a rolled photosensitive material for printing.

A conventional package for a rolled photosensitive material for printing is, as shown in FIGS. 15 and 15*a*, prepared by winding the photosensitive material around a core 90 to form the rolled photosensitive material 91, covering the peripheral surface of the rolled photosensitive material 91 by a light-shielding leader 92 to shield from light, covering both sides of the rolled photosensitive material by a pair of side plate inner rings 94 adhered to each side of the core 90 through an adhesive layer 93 to shield the both sides from light, and adhering an outer ring 95 onto each side plate inner ring 94 through an adhesive layer 96 (Japanese Patent KOKAI 62-172344, Japanesse Utility Model KOKAI 55-113543).

A package provided with many gusseted portions on the inner circumferential edge of the side plate inner ring is also known, the gusseted portions being adhered to the inner face of the core (Japanese Utility Model KOKAI 3-37447, Japanese Patent KOKAI 2-72347, U.S. Pat. No. 5,133,171, etc.).

In the above conventional package as shown in FIGS. 15 and 15*a*, since the side plate inner ring 94 was adhered to the side of the core 90 through a transparent adhesive layer 93, there was a problem occasionally to leak light into the package of the rolled photosensitive material 91 through the adhesive layer 93. In the case that the core was a plastic molded article, the manufacturing cost was expensive, and the core was occasionally incompatible with the photosensitive material. On the other hand, since the core molded of plastic was excellent in flatness of the side of the core, the thickness of the adhesive layer could be made thin, and the radial length of the core was relatively long, i.e. the distance from the outside to the rolled photosensitive material was long. As a result, the light-shielding was, in general, ensured.

However, in the case that the core was formed of paper, since the flatness of the end of the core was inferior, space was occasionally formed between the core and the adhesive layer. Moreover, the adhesive layer must be made thick in order to ensure adhesive strength, and the radial length of the core was short. As a result, light was liable to pass the adhesive layer to reach the rolled photosensitive material.

In the case of the conventional package provided with gusseted portions, light-shielding could be ensured even in the case that the core was formed of paper. However, gusseting to form the gusseted portions was complicated, and the gusseted portions were occasionally damaged by an axial rod upon loading in various apparatuses.

SUMMARY OF THE INVENTION

An object of the invention is to provide a package of a rolled photosensitive material capable of ensuring light-shielding at the side plate inner ring simply and inexpensively, and having a sufficient adhesive strength between the side plate inner ring and the core.

The present invention provides a package of a rolled photosensitive material which has achieved the above object, comprising a core, a rolled photosensitive material wound around the core, a light-shielding leader which shields the peripheral face of the rolled photosensitive material from light, a pair of side plate inner rings which shield both sides of the rolled photosensitive material, an adhesive layer which adheres each of the side plate inner rings to the core, a caulking part which is formed on the adhesive layer and which enters the core, and a light-shielding part which is formed on the side plate inner ring, which adheres to the caulking part, and of which the inner end is positioned on the inner part from the surface of the core.

BRIEF DESCRIPTION OF DRAWINGS

FIG. 1 is a partial section of a package of a rolled photosensitive material embodying the invention, FIG. 1*a* is a partially enlarge view thereof, and FIG. 2 is a side view thereof with partially broken away in the state that the side plate outer ring has been taken away.

FIG. 3 is a front view of a side plate inner ring used in an example of the package of a rolled photosensitive material of the invention.

FIGS. 4 through 7 are views illustrating a preparation procedure of the package of a rolled photosensitive material of the invention. FIG. 4 is a perspective view in a state that the light-shielding leader part has not been wound yet. FIG. 5 illustrates a state to adhere the side plate inner ring to the rolled photosensitive material, and FIG. 6 is a partial enlarged section of a thermal adhesion block for adhering the side plate inner ring. FIG. 7 illustrates a state to adhere the side plate outer ring.

FIG. 8 and 9 are partial enlarged sections illustrating other examples of the caulking part and the light-shielding part of the package of a rolled photosensitive material of the invention.

FIGS. 10 through 14 are front views illustrating several examples of the caulking part of the package of a rolled photosensitive material of the invention.

Figure 13:
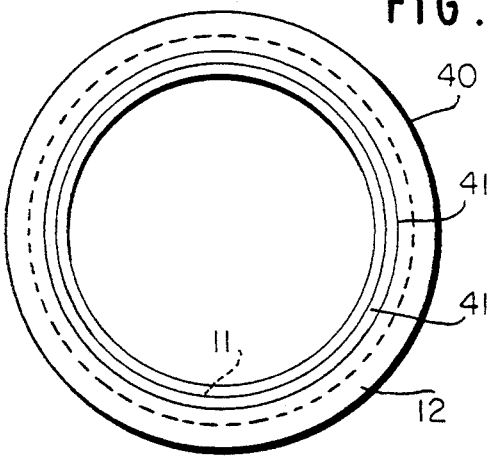

10 . . . Core
20 . . . Rolled photosensitive material
30 . . . Side plate inner ring
31 . . . Light-shielding part
40 . . . Adhesive layer
41 . . . Caulking part
50 . . . Light-shielding leader
60 . . . Side plate outer ring

DETAILED DESCRIPTION OF THE INVENTION

The caulking part is formed on the adhesive layer, and enters the core. The light-shielding part is formed on the side plate inner ring, and adheres to the caulking part. The inner end of the light-shielding part is positioned on the inner part from the surface of the core. A suitable position of the inner end of the light-shielding part enters not less than 0.05 mm, preferably not less than 0.10 mm, more preferably not less than 0.15 mm and not more than 7 mm, preferably not more than 3 mm, particularly preferably 0.2 to 1 mm.

The caulking part is in a form of rib. The section of the caulking part can be in various form, such as triangle, arc or rectangle. A suitable width of the caulking part is 0.05 to 2 mm, preferably 0.1 to 1 mm. The planar form of the caulking part may be circle, wave line or the like, and must be discontinuous within the range capable of shielding light. The caulking part may be doubled in order to ensure light-shielding more completely. The form of the light-shielding part becomes a similar figure of the caulking part.

As a means for forming the caulking part of the adhesive layer and the light-shielding part of the side plate inner ring, when both side of the core, e.g. made of paper, and the side plate inner ring are flexible, both of the caulking part and the light-shielding part can be formed at once by forming a rib having a prescribed form on a thermal adhesion block for adhering the side plate inner ring through the adhesive layer, and impressing the thermal adhesion block. When both of the core, e.g. made of plastic, and the side plate inner ring are hard, the caulking part and the light-shielding part are formed by forming previously onto the core a groove into which the caulking part enters, and fitting the adhesive layer and the side plate inner ring into the groove.

The impressing part of the thermal adhesion block at the caulking part and the light-shielding part is preferably formed of a separate hard member, such as stainless steel.

In the case that both of the core and the side plate inner ring are formed of hard material, it is preferable to form a groove on the core and the light-shielding part on the side plate inner ring previously.

The side plate inner ring is formed of a material capable of ensuring light-shielding, such as various polyethylene resins, various polyethylene terephthalate resins, various nylon resins and various polypropylene resins, blended with light-shielding material or laminated with metal foil such as aluminum foil.

Representative examples of the light-shielding material are shown below.

Oxides . . . Silica, diatomaceous earth, alumina, titanium oxide, iron oxide, zinc oxide, magnesium oxide, antimony oxide, barium ferrite, strontium ferrite, berylium oxide, pumice, pumice balloon, alumina fiber, etc.

Hydroxides . . . aluminum hydroxides, magnesium hydroxides, basic magnesium carbonate, etc.

Carbonates . . . calcium carbonate, magnesium carbonate, dolomite, dawsonite, etc.

Sulfates, sulfites . . . calcium sulfate, barium sulfate, ammonium sulfate, calcium sulfite, etc.

Silicates . . . talc, clay, mica, asbestos, glass fiber, glass balloon, glass bead, calcium silicate, montomorillonite, bentonite, zeolite, etc.

Carbons . . . carbon black, graphite, carbon fiber, carbon nollow bead, etc.

Others . . . iron powder, copper powder, lead powder, tin powder, stainless steel powder, pearl pigment, aluminum powder, molybdenum sulfide, boron fiber, silicon carbide fiber, brass fiber, potassium titanate, lead titanate zirconate, zinc borate, barium metaborate, calcium borate, sodium borate, aluminum paste, etc.

Among them, various carbon blacks are preferable in terms of rare adverse affect upon photographic film, great light-shielding ability and inexpensiveness. Carbon blacks are divided into gas black, oil furnace black, channel black, anthracene black, acetylene black, Ketschen carbon black, thermal black, lamp black, vegetable black and animal black according to their origin. Among these, oil furnace carbon black is preferable in terms of light-shielding ability, cost and improvement on properties. On the other hand, since acetylene black and Ketschen carbon black which is modified by-produced carbon black have an antistatic character, they are also preferable, though they are expensive. They may be blended to the oil furnace black according to properties to be required. There are various forms in blending the light-shielding material with a polyethylene polymer, but masterbatch method is preferable in view of cost and less contamination of working place.

Particularly preferable carbon black has a pH (JIS K 6221) of 4 to 9, preferably pH 6 to 8, a mean particle size measured by microscopy of 10 to 120 mμ, preferably 15 to 60 mμ, a volatile components content (JIS K 6221) of not more than 3.0%, preferably not more than 1.0%, particularly preferably not more than 0.8%, and an oil absorption value (JIS K 6221) of not less than 50 ml/100 g, preferably not less than 60 ml/100 g, particularly preferably not less than 70 ml/100 g, because of no degradation of photographic properties, such as fogging and sensitivity deviation, and no occurrence of foaming, silver streaks, etc. troubles, excellent dispersibility and rare occurrence of microgrits (agglomerates of impurities).

So as not to adversely affect photographic properties, it is preferable to select carbon black having a free sulfur content of not more than 0.6%, preferably not more than 0.3%, particularly preferably not more than 0.1%, a cyanogen compound content of not more than 0.01%, preferably not more than 0.005%, particularly preferably not more than 0.001%, and an aldehyde compound content of not more than 0.1%, preferably not more than 0.05%, particularly preferably not more than 0.01%. However, in the invention, it is not necessary to select carbon black so severely, because these materials affecting adversely are rendered harmless, and rarely affect adversely photographic properties. However, by selecting carbon black as above, the carbon black does not affect adversely photographic properties at all.

A suitable blending amount of the light-shielding material is 1 to 15 wt. %, preferably 2 to 10 wt. %, particularly preferably 3 to 7 wt. %.

The surface of light-shielding material can be coated in order to improve dispersibility of the light-shielding material, to improve resin fluidity, to prevent the occurrence of lumps which induce fogging, pressure marks, abrasion and the like on photographic photosensitive materials.

Representative coating by the surface-coating material are as follows:

(1) Using a coupling agent:

Coated with a coupling agent containing azidosilane compound (disclosed in Japanese Patent KOKAI No. 62-32125). Coated with a silane coupling agent (aminosilane etc.). Coated with a titanate coupling agent.

(2) Coated by depositing silica followed by depositing by alumina.

(3) Coated with higher fatty acid metal salt, such as zinc stearate, magnesium stearate or calcium stearate.

(4) Coated with surfactant, such as sodium stearate, potassium stearate or hydroxyethylene dodecylamine.

(5) Coated by reacting barium sulfide aqueous solution with sulfuric acid aqueous solution in the presence of an excess amount of barium ion to produce barium sulfate having a mean particle size of 0.1 to 2.5 μm, adding alkaline silicic acid solution thereto to deposit barium silicate on the surface of the barium sulfate, and depositing hydrous silica on the surface of the barium sulfate produced by the decomposition of the barium silicate by adding mineral acid to the slurry.

(6) Coated with a composition consisting of one or more of the oxides selected from hydrated oxides of metal, such as titanium, aluminum, cerium, zinc, iron, cobalt or silicon, and oxides of metal, such as titanium, aluminum, cerium, zinc, iron, cobalt or silicon.

(7) Coated with a polymer having one or more reactive groups selected from aziridine group oxiazoline group and N-hydroxyalkylamide group.

(8) Coated with polyoxyalkylene amine compound.

(9) Coated with cerium iron, selected acid anion and alumina.

(10) Coated with alkoxy titanium derivative having α-hydroxycarboxylic acid residue as substituent.

(11) Coated with polytetrafluoroethylene.

(12) Coated with polydimethylsiloxane or modified silicone.

(13) Coated with phosphate ester compound.

(14) Coated with divalent to tetravalent alcohol.

(15) Coated with olefin wax, such as polyethylene wax or polypropylene wax.

(16) Coated with hydrous aluminum oxide.

(17) Coated with silica if zinc compound consisting of zinc chloride, zinc hydroxide, zinc oxide, zinc sulfate, zinc nitrate, zinc acetate or zinc citrate of a combination thereof.

(18) Coated with polyhydroxyy saturated hydrocarbon. Others.

A suitable coating amount is 0.001 to 5 wt. %, preferably 0.01 to 3 wt. %, particularly preferably 0.05 to 1.5 wt. %, against light-shielding material.

The side plate inner ring may be blended with a lubricant for sliding during molding process.

Examples of lubricant are as follows:

Silicone lubricants:

dimethylpolysiloxanes, etc. (Sinetsu Chemical Co., Ltd., Toray Silicone Co., Ltd.), etc.

Oleic acid amide lubricants:

"ARMOSLIP-CP" (Lion Akzo Co., Ltd.), "NEWTRON" and "NEWTRON E-18" (Nippon Fine Chemical Co., Ltd), "AMIDE-O" (Nitto Kagaku K.K.), "DIAMID O-200" and "DIAMID G-200" (Nippon Kasei Chemical Co., Ltd.), "ALFLOW E-10" (Nippon Oil and Fats Co., Ltd.), etc.

Erucic acid amide lubricants:

"ALFLOW P-10" (Nippon Oil and Fats Co., Ltd.), etc.

Stearic acid amide lubricants:

"ALFLOW S-10" (Nippon Oil and Fats Co., Ltd.), "NEWTRON 2" (Nippon Fine Chemical Co., Ltd.), "DIAMID 200" (Nippon Kasei Chemical Co., Ltd.), etc.

Bis fatty acid amide lubricants:

"BISAMIDE" (Nitto Kagaku K.K.), "DIAMID-200 BIS" (Nippon Kasei Chmical Co., Ltd.), "ARMOWAX-EBS" (Lion Akzo Co., Ltd.), etc.

Alkylamine lubricants:

"ELECTROSTRIPPER TS-2" (Kao Corp.), etc.

Hydrocarbon lubricants:

liquid paraffin, natural paraffin, microwax, synthetic paraffin, polyethylene wax, polypropylene wax, chlorynated hydrocarbon, fluorocarbon, etc.

Fatty acid lubricants:

higher fatty acids preferably more than $C_{12}$, hydroxy fatty acids, etc.

Ester lubricants:

fatty acid lower alcohol esters, fatty acid polyol esters, fatty acid polyglycol esters, fatty acid fatty alcohol esters, etc.

Alcohol lubricants:

polyols, polyglycols, polyglycerols, etc.

Metallic soap:

metal salts such as Li, Mg, Ca, Sr, Ba, Zn, Cd, Al, Sn, Pb salts of higher fatty acids such as lauric acid, stearic acid, ricinoleic acid, naphthenic acid, oleic acid, etc.

As the preferable lubricant next to fatty amide lubricant, there is silicone lubricant. Although the silicone lubricant is expensive, it is the most suitable as the lubricant added to the heat sealing layer of a light-shielding bag for photographic photosensitive materials requiring complete light-shielding ability. Particularly, as a countermeasure to the degradation of heat sealability by blending lubricant, when the following silicone lubricant is blended into the heat sealing layer or the inner or outer surface layer containing not less than 5 wt. %, preferably not less than 20 wt. %, particularly preferably not less than 50 wt. %, of ethylene copolymer resin (ethylene-α-olefin resin which is excellent in sealability with other materials, hot tack properties, heat seal strength and physical strength is the most preferable) of a light-shielding bag, it exercises excellent properties which conventional packaging material for photographic photosensitive materials does not have.

Suitable silicone oils are those having modified siloxane bond, such as dimethylpolysiloxanes and modifications thereof in various grade (Shin-Etsu Silicone, Toray Silicone), polymethylphenysiloxane, α-methylstyrene-modified silicone, carboxyl-modified silicone, fluorine-modified silicone, alkyl-modified silicone, alkylaryl-modified silicone, olefin-modified silicone, amide-modified silicone, amino-modified silicone, polyether-modified silicone modified with polyethylene glycol, polypropylene glycol, etc., olefin/polyether-modified silicone, epoxy-modified silicone, alcohol-modified silicone, etc. Among them, preferred ones are olefin-modified silicone, amide-modified silicone, polyether-modified silicone, olefin/polyether-modified silicone polydialkylsiloxane.

Particularly, in the case that the packaging material for photographic photosensitive materials is a single layer or multilayer film, the silicone oil improves friction coefficient of the film in a heated condition, decreases sliding resistance generated during hot plate sealing in an automatic packaging machine and prevents the occurrence of wrinkling. Thereby, the silicone oil provides a basis of producing a film which has a beautiful appearance, a high sealability, and adhesion to an article to be packaged without sagging. It prevents the degradation of gloss by sliding to form a fine sealed portion. In the case of using silicone oil, friction coefficient at high temperature can be not more than 1.4 for sliding heat seal.

The above silicone oil has preferably a viscosity at ordinary temperature of 1,000 to 100,000 centistokes, more preferably 5,000 to 30,000 centistokes. A suitable blending amount is 0.01 to 5 wt. %, preferably 0.03 to 3 wt. %, particularly preferably 0.05 to 1.5 wt. %, although it varies according to the kind and the object of use.

The silicone lubricant may be a single kind, a combination of two or more kinds or a combination with other lubricant or plasticizer.

Effects of blending silicone oil are as follows. Silicone oil improves the dispersibility of resin, decrease motor load of screw and prevents the occurrence of melt fracture. Slipping character can be ensured sufficiently without blending fatty acid amide which tends to bleed out to generate white powder. A fine sealed portion can be formed by decreasing the friction coefficient of a molded article in heated conditions, improving automatic bag-making ability, and preventing the occurrence of wrinkling at the time of heat sealing and the reduction of gloss by sliding. When light-shielding material is combined, light-shielding ability can be improved synergistically, and light-shielding ability can be ensured, even though the blending amount of light-shielding material which degrades properties is decreased.

The form of the side plate inner ring is fundamentally disc with a center hole, and the outer diameter is almost the same as or slightly shorter than the outer diameter of the rolled photosensitive material within the range capable of ensuring light-shielding. The inner diameter is about consistent with the inner diameter of the core within the range capable of ensuring light-shielding and adhesive strength to the core. A suitable thickness of the side plate inner ring is 0.02 to 0.2 mm, preferably 0.03 to 0.1

It is preferable to form embossing in convex type on the side plate inner ring on the side of adhering to the core. By providing the convex type embossing, the side plate inner ring can keep its flatness upon covering the outer periphery of the side plate inner ring by the adhesive tape of the light-shielding leader after the side plate inner ring is adhered to the core.

The adhesive layer is formed of an adhesive capable of adhering the side plate inner ring to the core. Suitable adhesives include thermoplastic hot melt adhesives, ("Hirodain 4605" Hirodain Kogyo) thermoplastic hot melt adhesives, ("Nittait HB 195R", "Nittait HB 193M", "Nittait HC-130", Nitta Gelatin Inc.), and the like A suitable thickness of the adhesive layer is 20 to 70 μm, preferably 35 to 50 μm. The adhesive layer may be blended with light-shielding material in order to render light-shielding surer. The light-shielding material can be selected from those mentioned for the side plate inner ring.

The core has a construction capable of ensuring light-shielding and not affecting adversely the rolled photosensitive material. The core may be formed of paper material or plastic and may be single layer or a plurality of layers, including paper cores having 4 to 12 layer construction formed of different paper materials, and a plastic cores formed by injection molding of polystyrene resin, high-impact styrene resin or the like. In view of ensuring light-shielding, the thickness (length in radial direction) of the part for ensuring light-shielding (when the end of the core is closed by a material capable of ensuring light-shielding, the thickness corresponds to the half diameter) is preferably greater. A suitable thickness is not less than 0.5 mm, preferably not less than 2 mm, particularly preferably not less than 3 mm, and in the practical viewpoint, not more than 10 mm, preferably not more than 5 mm.

The side plate outer ring is incorporated in order to render light-shielding surer and to improve appearance. The form and the material of the outer ring may be similar to the inner ring or may be any other form or material capable of satisfying light-shielding ability and adhesive ability. The outer ring is attached, for example, by adhering to a side of the package by an adhesive.

The light-shielding leader is formed of a material capable of ensuring light-shielding, and the material used for the side plate inner ring can be used. The light-shielding leader has a rigidity capable of tearing both side adhesive tapes.

The rolled photosensitive material applicable to the invention includes photosensitive process films for printing, color photographic papers, photographic papers for computerized type-setting system, and the like.

In the package of a rolled photosensitive material of the invention, the light-shielding part of the side plate inner ring intercepts the light passed through the adhesive layer so as not to reach the rolled photosensitive material.

EXAMPLES

An example of the package of a rolled photosensitive material of the invention is illustrated in FIGS. 1, 1*a* and 2.

In the package, the core 10 is composed of a light-shielding layer 11 on the inside having light-shielding ability and a photosensitive material contact layer 12 on the outside having a very smooth surface without light-shielding ability. A long photosensitive material web is wound around the core 10 to form the rolled photosensitive material 20. The side plate inner ring in a doughnut form is close to a side end of the core 10 and the rolled photosensitive material 20, and adhered to the side end of the core 10 through the adhesive layer 40. The light-shielding leader 50 is wound around the peripheral face of the rolled photosensitive material 20. Side adhesive tapes 51 are joined to both sides of the light-shielding leader 50 by heat sealing, and the side adhesive tapes 51 are folded and adhered to the side plate inner ring 30, side plate outer ring 60 is adhered to the surface of the side plate inner ring 30 and the adhesive tape 51 through an adhesive layer 70.

A groove 13 having an almost triangle section was formed on the side end of the core 10 at the light-shielding layer 11 portion. The caulking part 41 of the adhesive layer 40 entered the groove 13, and the light-shielding part 31 of the side plate inner ring 30 in a form of a rib having an almost triangle section similar to the section of the groove 13 entered the caulking part 41. The top portion 32 of the light-shielding part 31 was positioned on the inside about 0.3 mm from the inner surface 42 of the adhesive layer 40.

Before joined to the core 10, the above side plate inner ring 30 was provided with embossing 33 in convex type radially, and could keep flatness by the embossing 33.

The light-shielding layer 11 of the above core 10 was formed of 90% of HONAP (Honshu alkaline pulp) and 10% of NUKP (Simpson Tacoma Kraft Company) and had a layer construction of 1 layer made by a short wire paper machine and 6 layers made by a cylinder machine. The areal weight was 380 g/cm$^2$, and the thickness was 500 μm (one layer).

The photosensitive material contact layer 12 was formed of 30% of NBKP (North Wood Pulp Co.) and 70% of LBKP (Alabama River Pulp Co.), and had a layer construction of 5 layers made by a cylinder machine. The areal weight was 360 g/cm$^2$, and the thickness was 480 μm (one layer).

The rolled photosensitive material 20 was a photosensitive process film for printing, a color photographic paper, a photographic paper for computerized type-setting system or the like.

The side plate inner ring 30 was composed of an aluminum foil 30 μm in thickness and two polyethylene terephthalate film layers each 12 μm in thickness laminated onto both sides of the aluminum foil through a polyurethane adhesive layer blended with 10% of carbon black.

The adhesive layer 40 was composed of an adhesive 43 of "Hirodain 4605", "Nittait HB 195R", "Nittait HB 193 M", "Nittait HC-130", or the like.

The light-shielding leader 50 was composed of a polyethylene terephthalate film 100 μm in thickness and two polyethyene sheets blended with 3 wt. % of carbon black each 40 μm in thickness laminated onto both sides of the polyethylene terephthalate film through a polyethylen adhesive layer formed by extrusion laminating.

The side plate outer ring 60 was composed of an aluminum foil 20 μm in thickness and two polyethylene terephthalate film layers each 12 μm in thickness laminated onto both sides of the aluminum foil through an adhesive layer for dry laminating blended with carbon black.

The adhesive layer 70 was composed of a hot melt adhesive.

In the above package of a rolled photosensitive material, the light entered from the end of the adhesive layer 40 was intercepted by the light-shielding part 31 of the side plate inner ring 30, and did not reach the photosensitive material contact layer 12 of the core 10. Accordingly, the light-shielding of the rolled photosensitive material 20 could be ensured. Besides, the adhesive layer 40 had a large contact area with the core 10, and entered the inside of the core 10. Accordingly, the adhesiveness between the side plate inner ring 30 and the core 10 was good.

The above package of the rolled photosensitive material was prepared as follows:

As shown in FIG. 4, a long photosensitive material web was wound around the core 10 to form the rolled photosensitive material 20, and the light-shielding leader 50 was joined to the leading end of the photosensitive material 20 by an adhesive tape 55. The light-shielding leader 50 had already been provided with a pair of side adhesive tapes 51 on both sides joined by heat sealing. Each side adhesive tape 51 is torn at both sides of the light-shielding leader, a notch 53 for the start of cutting and incisions 54 for facilitating to adhere to the side plate inner ring.

Subsequently, as shown in FIG. 5, the adhesive 43 was applied onto the side plate inner ring 30 at the part to contact the core 10, and then, the side plate inner ring 30 was pressed to adhere to the core 10 by a thermal adhesion block apparatus 80 at 180° to 220° at a pressure of 40 to 100 kgf for 3 to 20 seconds. The pressing was conducted from both sides of the rolled photosensitive material 20 so as to nip it using two thermal adhesion block apparatuses. The thermal adhesion block apparatus 80 was provided with a cylindrical guide part 81 to be inserted into the core 10, and a thermal adhesion block 82 made of iron was disposed surrounding the periphery of the guide part 81. The thermal adhesion block 82 was, as shown in FIG. 6, fixed by a projected ring 83 made of stainless steel incorporated at the top portion, and the projected ring 83 formed the caulking part 41 of the adhesive layer 40 and the light-shielding part 31 of the side plate inner ring 30.

Then, as shown in FIG. 7, the light-shielding leader 50 was wound and fixed by an end-fixing tape 56, and the side adhesive tapes 51 were folded to adhere to the side plate inner ring 30. Thee side plate outer ring 60 was adhered to the side plate inner ring 30 and the side adhesive tape 51 throught the adhesive layer 70 to complete the package.

Several modifications are illustrated in FIGS. 8–14.

In the example of FIG. 8, all of the groove 13, the caulking part 41 and the light-shielding part 31 are formed into a semicircle in section.

In the example of FIG. 9, all of the groove 13, the caulking part 41 and the light-shielding part 31 are formed into a rectangle in section.

In the example of FIG. 10, all of the groove 13, the caulking part 41 and the light-shielding part 31 are formed into a wavy circle in planar figure.

In the example of FIG. 11, all of the groove 13, the caulking part 41 and the light-shielding part 31 are formed into a gear form circle in planar figure.

On the example of FIG. 12, all of the groove 13, the caulking part 41 and the light-shielding part 31 are formed into a hexagon in planar figure.

In the example of FIG. 13, all of the groove 13, the caulking part 41 and the light-shielding part 31 are formed into a double concentric circle in planar figure.

Figure 14:
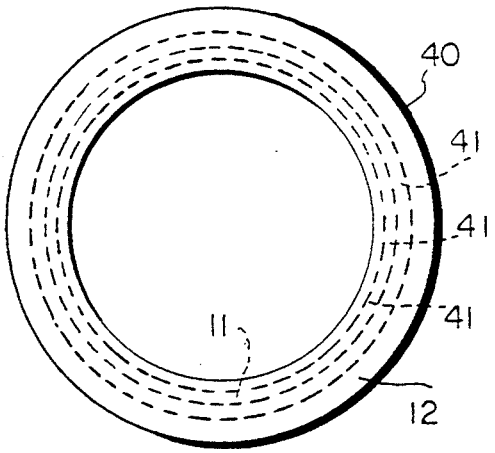
Figure 15A:
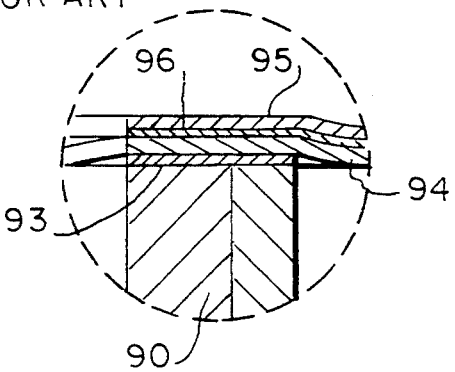
FIG. 15A PRIOR ART
FIG. 15*a* is a partially enlarged view of the conventional package shown in FIG. 15.
Figure 15:
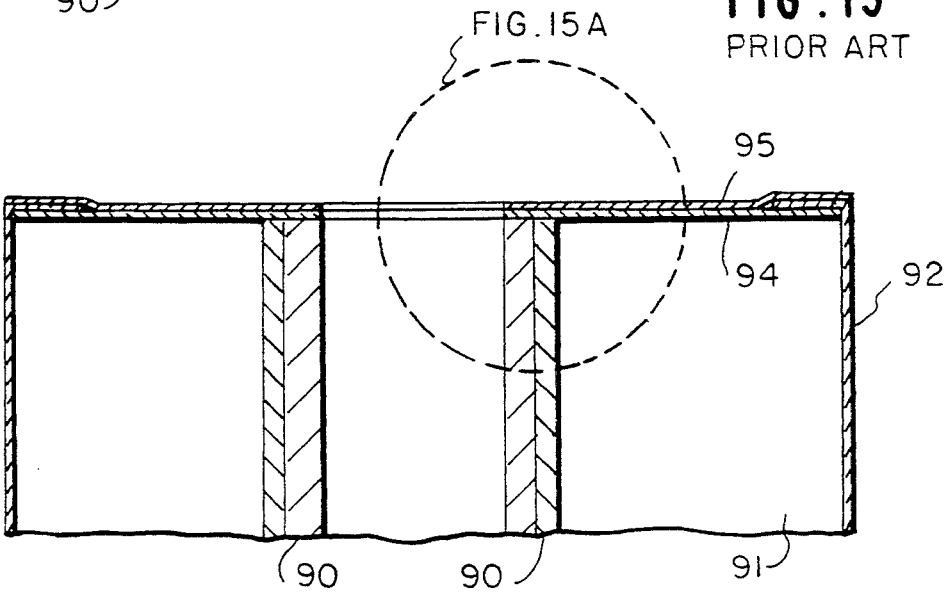
FIG. 15 PRIOR ART
FIG. 15 is a partial section of a conventional package of a rolled photosensitive material.

In the example of FIG. 14, all of the groove 13, the caulking part 41 and the light-shielding part 31 are formed into a double concentric circle formed by broken line.

We claim:

1. A package of a rolled photosensitive material, comprising a core, a rolled photosensitive material wound around the core, a light-shielding leader for shielding a peripheral face of the rolled photosensitive material from light, a pair of side plate inner rings for shielding both sides of the rolled photosensitive material, an adhesive layer for adhering each of the side plate inner rings to the core, the adhesive layer having a caulking part at a location entering the core, each side plate inner ring having a light-shielding part formed on the side plate inner ring at a location adhering to the caulking part, the light-shielding part of each side plate inner ring having an inner end positioned on an inner part of the core.

2. The package of claim 1, wherein the inner end of the light-shielding part is positioned on the inner part of the core at a position at least 0.1 mm an inner surface of the core.

3. The package of claim 1, wherein the core is composed of an inner light-shielding layer and an outer photosensitive material contact layer having a smooth surface, the light-shielding layer having a thickness of at least 0.5 mm.

4. The package of claim 3 wherein the caulking part of the adhesive layer is located on the light-shielding layer of the core.

5. The package of claim 1, wherein the core comprises paper.

6. The package of claim 1, wherein the core has a groove located in an end surface thereof, the caulking part of the adhesive layer and the light-shielding part of the side plate being located in the groove.

7. The package of claim 6, wherein the groove has a triangular cross section.

8. The package of claim 6, wherein the inside diameter of the side plate inner ring is consistent with the inside diameter of the core.

9. The package of claim 6, wherein the thickness of the core is 0.5 to 5 mm.

10. The package of claim 1, further comprising a pair of side plate outer rings having an inside diameter consistent with the inside diameter of the core and an outside diameter consistent with the outside diameter of the roll of the photosensitive material and a pair of side adhesive tapes joined to both sides of the light-shielding leader, the side plate inner ring having an inside diameter consistent with the inside diameter of the core and an outside diameter consistent with the outside diameter of the roll of the photosensitive material, the side adhesive tape being folded and adhered to the outside of the side plate inner ring, and the side plate outer ring being adhered to the side plate inner ring and the adhesive tape.

11. A method of preparing a package of a rolled photosensitive material, comprising a core, a rolled photosensitive material wound around the core, a light-shielding leader for shielding a peripheral face of the rolled photosensitive material from light, a pair of side plate inner rings for shielding both sides of the rolled photosensitive material, an adhesive layer for adhering each of the side plate inner rings to the core, the adhesive layer having a caulking part at a location entering the core, each side plate inner ring having a light-shielding part formed on the side plate inner ring at a location adhering to the caulking part, the light-shielding part of each side plate inner ring having an inner end positioned on an inner part of the core, the method comprising the steps of nipping with pressure the rolled photosensitive material having a pair of the side plate inner rings applied on both sides thereof by the adhesive layer using two thermal adhesion blocks having a projected ring to form the caulking part and the light-shielding part and to adhere the side plate inner rings to the rolled photosensitive material.

12. The method of claim 11, further comprising the step of convex type embossing of the side plate inner ring before the nipping.

13. The method of claim 11, wherein the nipping comprises pressing the projecting ring into the side plate inner ring to form a groove in an end surface of the core, the notch containing the caulking part of the adhesive layer and the inner end of the side plate inner rings.

* * * * *